US008281922B2

(12) United States Patent
Chatelain

(10) Patent No.: US 8,281,922 B2
(45) Date of Patent: Oct. 9, 2012

(54) HINGE LID CONTAINER AND BLANK

(75) Inventor: Lucas Chatelain, Savigny (CH)

(73) Assignee: Philip Morris USA Inc., Richmond, VA (US)

( * ) Notice: Subject to any disclaimer, the term of this patent is extended or adjusted under 35 U.S.C. 154(b) by 98 days.

(21) Appl. No.: 12/686,682

(22) Filed: Jan. 13, 2010

(65) Prior Publication Data

US 2010/0176011 A1 Jul. 15, 2010

(30) Foreign Application Priority Data

Jan. 14, 2009 (EP) ..... 09250083

(51) Int. Cl.
*B65D 85/10* (2006.01)

(52) U.S. Cl. ..... 206/267; 206/273

(58) Field of Classification Search ..... 206/271, 206/273, 275, 267, 268, 265, 264, 250, 242
See application file for complete search history.

(56) References Cited

U.S. PATENT DOCUMENTS

| | | | |
|---|---|---|---|
| 149,889 | A | 4/1874 | Smith |
| 727,600 | A | 5/1903 | Doscher |
| 1,185,560 | A | 5/1916 | Walcutt |
| 1,459,439 | A | 6/1923 | Burton |
| 1,562,497 | A | 11/1925 | Roberts |
| 1,608,229 | A | 11/1926 | Twomley |
| 2,163,828 | A | 6/1939 | Walker |
| 2,213,525 | A | 9/1940 | LaFlamme |
| 2,597,810 | A | 5/1952 | Myers |
| 2,799,441 | A | 7/1957 | Nerney |
| 2,872,097 | A | 2/1959 | Graybill |
| 2,929,542 | A | 3/1960 | O'Gorman |
| 2,990,994 | A | 7/1961 | Hackmyer |
| 3,311,283 | A | 3/1967 | Katsuji et al. |

(Continued)

FOREIGN PATENT DOCUMENTS

DE 570 351 2/1933

(Continued)

OTHER PUBLICATIONS

European Search Report dated May 2, 2007, issued in European Patent Application No. EP 06 25 6126.

(Continued)

*Primary Examiner* — Jacob K Ackun, Jr.
(74) *Attorney, Agent, or Firm* — Buchanan Ingersoll & Rooney PC

(57) ABSTRACT

A slide and shell container for consumer goods includes an outer shell and an inner slide. The inner slide includes a box and a lid, which is hingedly connected to the box at a hinge. The inner slide is slidable within the outer shell between a closed position in which the lid is closed and an open position in which the lid is open. The lid includes a lid flap which is arranged between the inner slide and the outer shell such that an engagement of the lid flap and the outer shell is capable of opening the lid. The lid flap is capable of engaging with the outer shell during movement of the inner slide from the closed position to the open position. The lid also includes a top wall, a back wall, a first side wall and a second side wall. The first side wall is connected through a fold line to the back wall and is connected through a fold line to the top wall.

7 Claims, 5 Drawing Sheets

U.S. PATENT DOCUMENTS

| | | | | |
|---|---|---|---|---|
| 3,327,888 | A | 6/1967 | Chalmers et al. | |
| 3,400,874 | A | 9/1968 | Shimada et al. | |
| 3,416,719 | A | 12/1968 | Pilger | |
| 3,858,788 | A | 1/1975 | Phillips, Jr. | |
| 3,899,125 | A | 8/1975 | Andrews et al. | |
| 3,933,299 | A | 1/1976 | Shimada et al. | |
| 3,977,520 | A | 8/1976 | Grimm | |
| 4,049,117 | A | 9/1977 | Grimm | |
| 4,267,926 | A | 5/1981 | Toimil | |
| 4,646,960 | A | 3/1987 | Challand | |
| 4,714,082 | A | 12/1987 | Banerjee et al. | |
| 4,729,508 | A * | 3/1988 | Erdmann et al. | 229/146 |
| 4,779,723 | A * | 10/1988 | Focke et al. | 206/273 |
| 4,923,059 | A | 5/1990 | Evers et al. | |
| 5,692,525 | A | 12/1997 | Counts et al. | |
| 6,044,973 | A | 4/2000 | Vasudeva | |
| 6,162,516 | A | 12/2000 | Derr | |
| 6,474,468 | B1 | 11/2002 | Griffith | |
| 6,527,166 | B1 | 3/2003 | Focke et al. | |
| 6,591,982 | B2 | 7/2003 | Focke et al. | |
| 7,273,145 | B2 | 9/2007 | Focke et al. | |
| 7,604,117 | B2 * | 10/2009 | Bourgoin et al. | 206/267 |
| 2002/0000389 | A1 * | 1/2002 | Garcia | 206/236 |
| 2004/0026271 | A1 | 2/2004 | Conti et al. | |
| 2004/0026272 | A1 | 2/2004 | Conti et al. | |
| 2005/0029131 | A1 | 2/2005 | Draghetti et al. | |
| 2005/0103654 | A1 * | 5/2005 | Hennessy | 206/270 |
| 2006/0278542 | A1 | 12/2006 | Pham et al. | |
| 2008/0121538 | A1 | 5/2008 | Buse | |
| 2008/0128301 | A1 | 6/2008 | Bourgoin et al. | |
| 2008/0142578 | A1 * | 6/2008 | Vickerstaff | 229/125.37 |
| 2009/0008277 | A1 * | 1/2009 | Agirbas | 206/267 |
| 2009/0065561 | A1 | 3/2009 | Bourgoin et al. | |
| 2009/0184158 | A1 | 7/2009 | Lutzig et al. | |
| 2010/0032324 | A1 | 2/2010 | Lutzig et al. | |
| 2010/0065449 | A1 * | 3/2010 | Morgan et al. | 206/268 |
| 2010/0155273 | A1 | 6/2010 | Chatelain | |

FOREIGN PATENT DOCUMENTS

| | | | |
|---|---|---|---|
| DE | 1054373 | B | 4/1959 |
| DE | 7525528 | U | 12/1975 |
| DE | 7826336 | U1 | 12/1978 |
| DE | 90 11 464 | | 1/1991 |
| DE | 202005011562 | U1 | 9/2005 |
| EP | 1927549 | A1 | 11/2006 |
| EP | 1847478 | A1 | 10/2007 |
| FR | 1037831 | A | 9/1953 |
| FR | 2495114 | A | 6/1982 |
| GB | 395 501 | | 7/1933 |
| GB | 468409 | | 7/1937 |
| GB | 532 784 | | 1/1941 |
| GB | 1042445 | | 9/1966 |
| GB | 1075618 | A | 7/1967 |
| GB | 2 309 021 | A | 7/1997 |
| GB | 2 396 854 | A | 7/2004 |
| JP | 2000-85749 | | 3/2000 |
| WO | WO 03/024839 | A | 3/2003 |
| WO | WO 03/091130 | | 11/2003 |
| WO | WO 2005/016036 | A1 | 2/2005 |
| WO | WO 2007/028481 | A1 | 3/2007 |
| WO | WO 2007/060395 | A1 | 5/2007 |
| WO | WO 2008/065038 | | 6/2008 |

OTHER PUBLICATIONS

International Search Report for European Application No. 06125140.1-2308 dated May 2, 2007.

International Search Report and Written Opinion mailed Apr. 21, 2010 for PCT/EP2009/008831.

International Search Report and Written Opinion mailed Apr. 8, 2010 for PCT/EP2009/009215.

International Search Report and Written Opinion mailed Apr. 1, 2009 for PCT/EP2009/000318.

Search Report from European Patent Application No. EP07115236.

International Search Report and Written Opinion mailed May 11, 2009 for PCT/IB2008/003014.

International Search Report dated Jun. 4, 2008 for European Patent Application No. 08253880.2-1261.

International Preliminary Report on Patentability issued Mar. 2, 2010 for PCT/IB2008/003014.

International Search Report dated Feb. 3, 2010 for European Patent Application No. 09252010.5-2308.

U.S. Appl. No. 12/858,874 to Chatelain et al., filed Aug. 18, 2010.

International Preliminary Report on Patentability mailed Jul. 28, 2011 for International Application No. PCT/EP2009/009215.

* cited by examiner

HINGE LID CONTAINER AND BLANK

CROSS-REFERENCE TO RELATED APPLICATION

This application claims priority to European Application No. 09250083.4, filed Jan. 14, 2009, the entire content of which is incorporated herein by this reference thereto.

BACKGROUND

The present invention relates to a novel slide and shell container for consumer goods. The container finds particular application as a container for elongate smoking articles, such as cigarettes.

It is known to package consumer goods in containers including an outer shell or sleeve and an inner slide or tray in which the consumer goods are housed and which is slidable within the outer shell. To remove consumer goods from such containers, a consumer slides the inner slide from an initial position within the outer shell to an open position in which the inner slide projects outwardly from the outer shell, in order to partially expose an open end or side of the inner slide.

For example, EP-A-1,847,478 and U.S. Pat. No. 3,400,874 disclose slide and shell containers wherein the slide includes a box and a lid wherein the lid is attached to the box at a hinge. The lid includes a flap on the outside thereof, which engages with a flap on the inner surface of the shell as the shell is moved into the open position of the container. The flap is pulled along with the shell, thereby pivoting the lid about the hinge to open the slide to allow access to the consumer goods.

In containers, typically at least a portion of both sides of the blank are exposed on the external surface of the lid when the container is assembled. Accordingly, if it is desired to provide a container having printing on all of the external surfaces, it has been necessary to use a blank for the slide that has been printed on both sides.

It would be desirable to provide an improved slide and shell container which has printing provided on all of the external surfaces but in which the panels are connected to each other in such a way that the slide of the container can be formed from a blank that has been printed on one side only.

SUMMARY

A slide and shell container for consumer goods includes an outer shell and an inner slide. Preferably, the inner slide includes a box and a lid and the lid is hingedly connected to the box at a hinge. In the preferred embodiment, the inner slide is slidable within the outer shell between a closed position in which the lid is closed and an open position in which the lid is open. Also preferably, the lid includes a lid flap, which is arranged between the inner slide and the outer shell such that an engagement of the lid flap and the outer shell is capable of opening the lid and the lid flap is capable of engaging with the outer shell during movement of the inner slide from the closed position to the open position. Moreover, the lid includes a top wall, a back wall, a first side wall and a second side wall. Preferably, the first side wall is connected through a fold line to the back wall, and the first side wall is connected through a fold line to the top wall. In the preferred embodiment, the outer shell includes a top opening flap extending from the top back edge of the outer shell and is arranged between the outer shell and the inner slide such that as the inner slide is moved from the closed position towards the open position, the top opening flap of the outer shell engages with the lid flap of the lid of the inner slide. Preferably, the box of the inner slide includes at least one stopper flap, which engages with the outer shell such that movement of the outer shell beyond the closed and open positions is substantially prevented. Also preferably, the lid includes a lid inner top wall connected by a fold line to the lid top wall. Moreover, the lid back wall includes two separate panels. In the preferred embodiment, the slide and shell container may also include smoking articles.

In a preferred embodiment, the inner slide is formed from a single laminar blank. Preferably, the blank includes a box-defining portion and a lid-defining portion connected along a transverse hinge. Also preferably, the lid-defining portion includes: a first lid side wall panel; a lid top wall panel connected to the first lid side wall panel along a first fold line; and a lid back wall panel connected to the first lid side wall panel along a second fold line substantially perpendicular to the first fold line.

DETAILED DESCRIPTION

Figure 1:
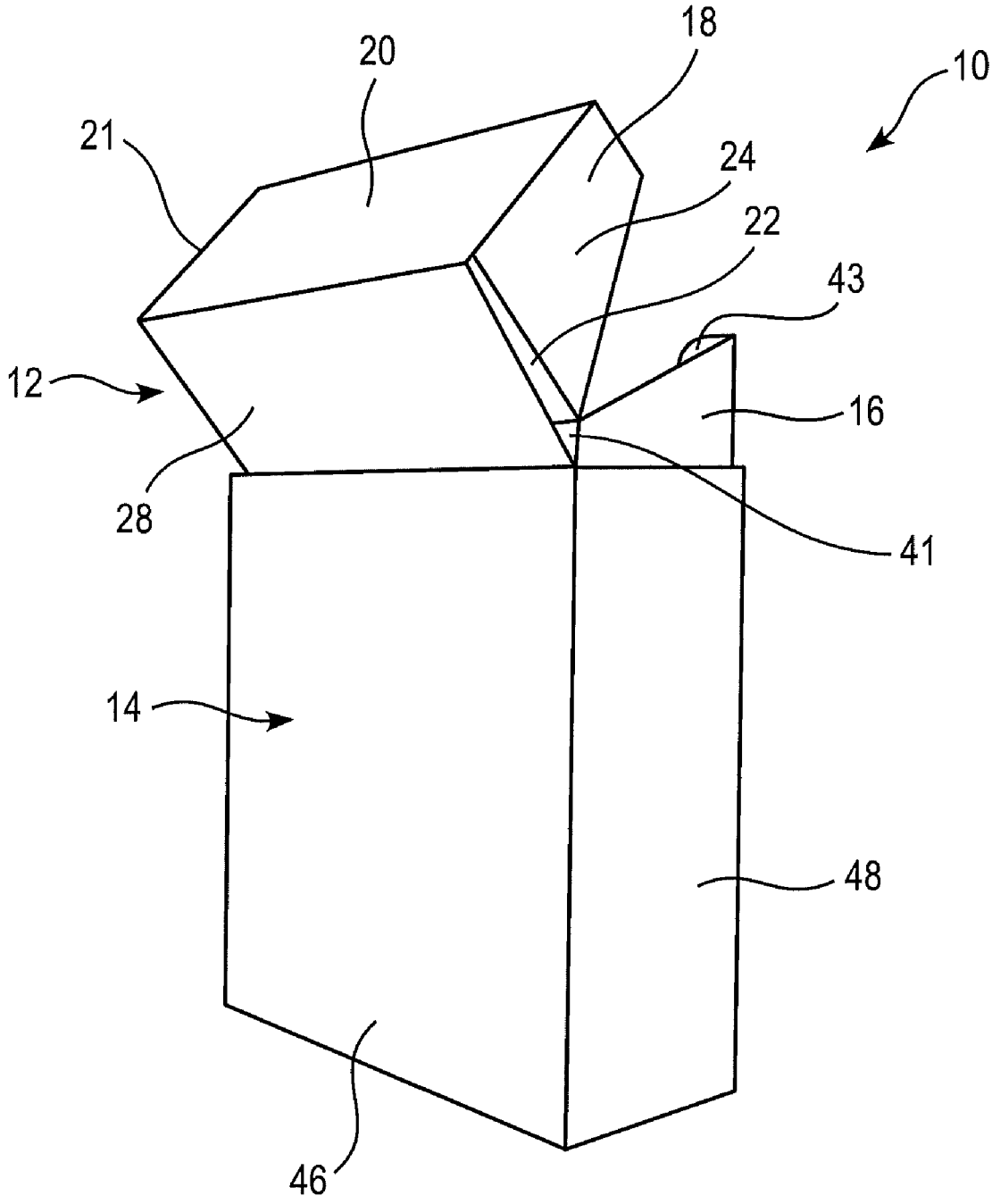
FIG. 1 is a perspective view of a container according to the first embodiment of the present invention, with the lid in an open position.

A slide and shell container for consumer goods includes an outer shell and an inner slide. Preferably, the inner slide includes a box and a lid. Also preferably, the lid is hingedly connected to the box at a hinge. Moreover, the inner slide is slidable within the outer shell between a closed position in which the lid is closed and an open position in which the lid is open. The lid includes a lid flap. The lid flap is arranged between the inner slide and the outer shell such that an engagement of the lid flap and the outer shell is capable of opening the lid and wherein the lid flap is capable of engaging with the outer shell during movement of the inner slide from the closed position to the open position. The lid includes a lid top wall, a lid back wall, a first lid side wall and a second lid side wall. The first side wall is connected through a fold line to the back wall. Furthermore, the first side wall is connected through a fold line to the top wall. This way, there is no direct connection between the lid back wall and the lid top wall.

The terms “front”, “rear”, “upper, “lower”, “side”, “top”, “bottom”, “left”, “right” and other terms used to describe relative positions of the components of containers refer to the container in an upright position. When the container in the upright position is open, the consumer goods contained in the inner slide may be removed from the top end of the container.

The term “hinge” refers to a line about which the lid may be pivoted in order to open the container. A hinge may be, for example, a fold line or a score line in the panel forming the rear wall of the container. Alternatively, a hinge may be a fold line or a score line in a piece of material bridging the lower edge of the rear wall of the lid and the top edge of the rear wall of the box. Such a piece of material may be, for example, a label that is permanently or removably attached to the rear wall of the lid and the rear wall of the box. Preferably, the hinge is positioned along the rear wall of the container at a level below the top edge thereof.

The term "fold line" refers to a line of weakness between two panels of the container, about which one panel may be folded relative to the other. The fold line may be, for example, a score line, a line of perforations or, a crease line.

The term "transverse" used in relation to hinges or fold lines, means that the hinge or fold line extends across the container from one side to the other, rather than between the top and bottom of the container. Typically, when the container is in an upright position, the transverse hinges or fold lines will be oriented substantially horizontally.

Preferably, the box of the slide includes a box front wall, a box back wall, a box bottom wall and box side walls.

In the lid of the container, the top wall panel is connected to a side wall panel and this enables the lid flap to be connected directly to the rear edge of the lid top wall panel. Unlike in the containers of the prior art, the blank therefore does not need to be folded back on itself at the front edge of the lid in order to provide the lid flap. This, in turn, means that the external surfaces of the box and the lid are all provided by the same surface of the laminar blank, so that only one side of the blank is required to be printed. The single-sided blank can advantageously be printed using single pass printing, which is both faster and cheaper than techniques required to print double-sided blanks.

Preferably, the inner slide of a container is formed from a laminar cardboard blank. With cardboard blanks it is typically necessary to coat the surfaces of the blank to which printing will subsequently be applied. Since the containers may be formed from blanks having printing on a single side, it is only necessary to provide the coating layer on the side of the blank forming the external surfaces of the container.

The container may be opened and closed by moving the inner slide relative to the outer shell. As the inner slide is moved from its closed position to its open position, the outer shell engages at least a part of the lid flap. Once the outer shell and lid flap are engaged in this way, the lid flap is effectively locked to the outer shell so that any further movement of the inner slide towards the open position will cause the lid to pivot open.

In preferred embodiments of the present invention, the inner slide is moved in an upwards direction relative to the outer shell in order to move it from the closed position to the open position. This may be achieved by applying an upwards force to the bottom of the inner slide while holding the outer shell, or alternatively by sliding the outer shell in a downwards direction while holding the inner slide.

Preferably, the free end of the lid flap is folded back on itself to provide an opening tab which engages with the outer shell as the inner slide is moved from the closed position to the open position.

Preferably, the outer shell also includes an opening tab which is folded against the inside of the outer shell and is arranged such that it engages with the opening tab of the lid flap. The opening tab preferably extends from the top edge of the rear wall panel of the outer shell and is therefore folded in the opposite direction to the opening tab of the lid flap, such that the opening tabs interlock with each other as the inner slide is moved in an upwards direction.

Preferably, a transverse fold line extends across the lid flap in order to allow for the bending of the lid flap as the lid pivots open.

Preferably, the inner slide includes one or more stopper flaps in at least one of the front wall and the rear wall of the box. The one or more stopper flaps interact with the outer shell to limit the movement of the inner slide relative to the outer shell in at least one direction. Preferably, the one or more stopper flaps limit the movement of the inner slide relative to the outer shell in both the upwards and downwards direction. This advantageously prevents the inner slide from being entirely removed from the outer shell.

Preferably, the outer shell includes one of more stopper flaps which interact with the stopper flaps of the inner slide to prevent movement of the inner slide beyond either the closed position or the open position.

Preferably, the lid further includes an additional inner lid wall connected to the lid top wall along a third transverse fold line extending across the top, front edge of the lid, opposed to the second transverse fold line. The additional lid wall panel may be folded substantially at right angles to the lid top wall panel in order to provide a lid front wall, or alternatively may be folded back against the lid top wall panel in order to provide an inner lid top wall panel.

In certain embodiments, the outer shell is of substantially the same length as the inner slide, such that in its closed position, the inner slide is enclosed within the outer shell. In other embodiments, the outer shell surrounds only a part of the inner slide, such that at least a portion of the inner slide is exposed in both the closed and open positions. For example, the length of the outer shell may be smaller than the length of the inner slide. The outer shell may extend around the entire circumference of the inner slide. Alternatively, the outer shell may extend only part way around the inner slide.

Preferably, containers further include a friction element to increase the friction between the outer shell and the inner slide during the movement of the inner slide between the closed and open positions. For example, the box of the inner slide may include one or more friction elements protruding from at least one of the side walls, which engage with the inner surface of the outer shell. The outer shell may additionally include one or more correspondingly positioned engaging flaps which engage with the friction elements of the box. A higher level of friction between the inner slide and outer shell advantageously prevents inadvertent opening of the inner slide.

Containers may be substantially rectangular parallelepipedal in shape, with right-angled longitudinal and right-angled transverse edges. Alternatively, the box or the lid or both the box and the lid of containers may include one or more generally rounded longitudinal edges, generally rounded transverse edges, generally bevelled longitudinal edges or generally bevelled transverse edges, or combinations thereof. For example, by scoring in a known manner a laminar blank from which the box and the lid of the container are erected, a pack with four generally longitudinally rounded corners, a so called "rounded-corner" pack may be produced.

The container may be formed from any suitable materials including, but not limited to, cardboard, paperboard, plastic, metal, or combinations thereof. Preferably, the container is formed from a folded laminar cardboard blank. Preferably, the cardboard has a weight ranging from about 100 grams per square meter to about 350 grams per square meter.

The inner slide and outer shell may be formed of the same or different materials to each other. When the same material is used to form both the inner slide and the outer shell, the thickness of the materials may be the same or different to each other and the finishing of the materials may be the same or different. Additionally, one or more of the blanks, for example the slider blank, may be made of transparent material.

Containers find particular application as packs for elongate smoking articles such as, for example, cigarettes, cigars or cigarillos. It will be appreciated that through appropriate choices of the dimensions thereof, containers may be designed for different numbers of conventional size, king size, super-king size, slender or very slender cigarettes. Alternatively, other consumer goods may be housed inside the container.

Through an appropriate choice of the dimensions thereof, containers may also be designed to hold different total numbers of smoking articles, or different arrangements of smoking articles. For example, through an appropriate choice of the dimensions thereof, containers may be designed to hold a total of ten, fifteen, sixteen, seventeen, eighteen, nineteen, twenty, twenty-one or twenty five smoking articles. These may be arranged in different collations, depending on the total number of smoking articles. For example, the smoking articles may be arranged in one row of six, seven, eight, nine or ten; two rows of five, six, seven, eight, nine or ten; two rows of 5-6, 6-7, 7-8; three rows of 5-5-5, 5-6-5, 6-5-6, 5-6-7, 6-7-6, 7-5-7, 7-6-7, 7-7-7, 8-9-8; four rows of four, five or six.

The two bundles may contain cigarettes of the same type or brand, or of different types or brands. In addition, both cigarettes without filters and cigarettes having many different types of filter tips may be contained as well as cigarettes of differing length (for example, ranging from about 4 cm to about 18 cm), and/or diameter (for example, ranging from about 4 mm to about 9 mm). In addition, the smoking articles may differ in strength of taste, resistance to draw and total particulate matter delivery. Preferably, the dimensions of the container are adapted to the length and the collation of the smoking articles. Typically, the outer dimensions of the container range from about 0.5 mm to about 5 mm larger than the dimensions of the collation of smoking articles housed inside the container.

The length, width and depth of containers may be such that, in the closed position, the resultant overall dimensions of the container are similar to the dimensions of a typical disposable hinge-lid pack of twenty cigarettes.

The exterior surfaces of containers according to the invention may be printed, embossed, debossed or otherwise embellished with manufacturer or brand logos, trade marks, slogans and other consumer information and indicia.

Once filled, containers may be shrink wrapped or otherwise over wrapped with a transparent polymeric film of, for example, polyethylene or polypropylene in a conventional manner. Where containers are over wrapped, the over wrapper may include a tear tape. In addition, the over wrapper may be printed with images, consumer information or other data.

A blank for making the inner slide of a slide and shell, as described above, includes a box-defining portion and a lid-defining portion connected along a transverse hinge. The lid-defining portion includes: a first lid side wall panel; a lid top wall panel connected to the first lid side wall panel along a first fold line; and lid top wall panel connected to the first lid side wall panel along a second fold line substantially perpendicular to the first fold line. In the assembled container, the box-defining portion corresponds to the box of the slide and the lid-defining portion corresponds to the lid of the slide.

The laminar blanks and hinge-lid containers shown in the figures have several components in common; these have been given the same or similar reference numerals throughout. In particular, the panels of the laminar blank are referred to using the same reference numerals as the walls formed by those panels in the assembled container. Fold lines are indicated as dashed lines on the laminar blanks.

The container 10 of FIG. 1 includes an inner slide 12 mounted within an outer shell 14 for movement relative thereto between the open position shown in FIG. 1 and a closed position. In the closed position, the inner slide 12 is inside the outer shell 14 such that only the top and bottom walls are visible.

The inner slide 12 includes a box 16 and a lid 18 connected to the box 16 at a hinge 27 extending across the rear wall 41 of the inner slide 12. The lid 18 is substantially trapezoidal in shape viewed from the side and includes a lid top wall 20, a lid back wall 22, a lid right (first) side wall 25 (shown in FIG. 2*a*), a lid left (second) side wall 24 and a lid inner top wall 26 (shown in FIG. 2*a*). In addition, the lid 18 includes a lid flap 28 extending from the top, rear edge of the lid. The lid flap 28 lies between the outer shell 14 and the rear wall of the inner slide 12 and extends beyond the level of the hinge connecting the lid 18 to the box 16.

Figure 2A:
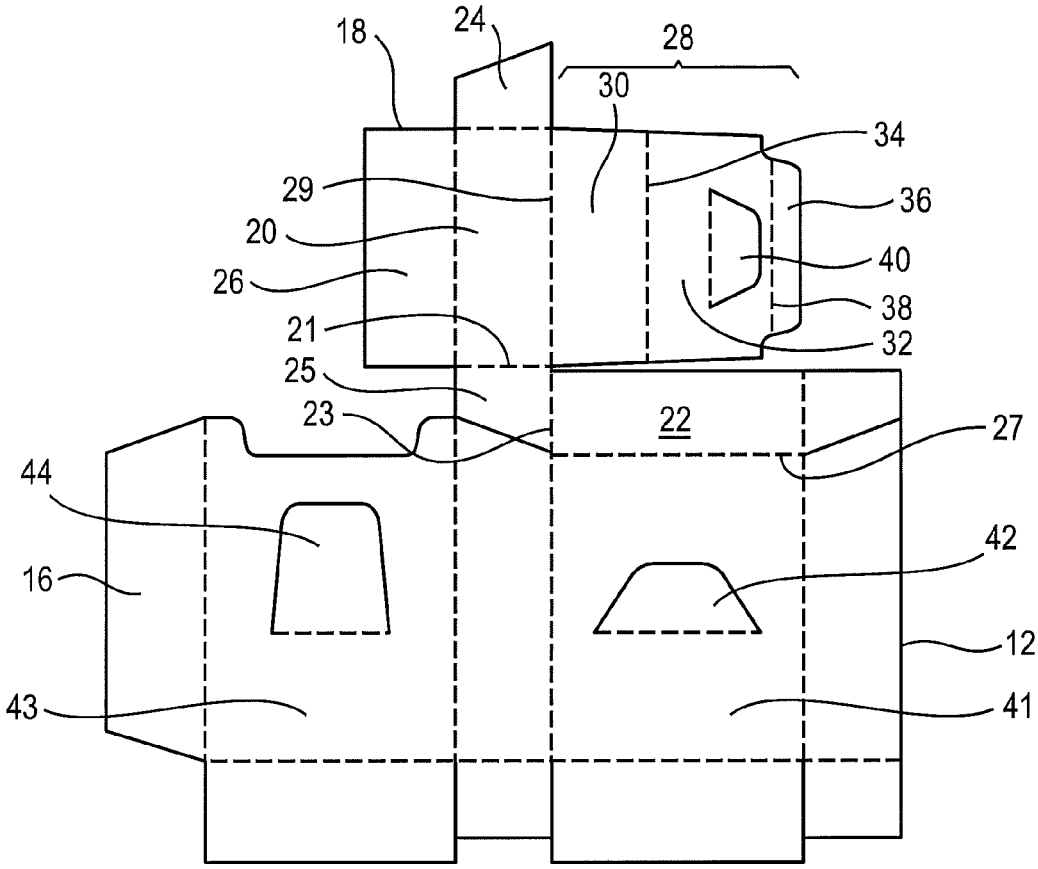
FIGS. 2*a* and 2*b* are plan views of the laminar blanks for forming the inner slide and outer shell, respectively, of the container of FIG. 1.

FIG. 2*a* shows the laminar blank for forming the inner slide 12 of the container 10 (shown in FIG. 1). As can be seen from FIG. 2*a*, the lid top wall panel 20 is connected to the lid right side wall panel 25 along a transverse fold line 21. The lid flap 28 is connected to the lid top wall panel 20 about a fold line 29 at substantially a right angle to the transverse fold line 21. The right side wall 25 is also connected by a fold line 23 to the lid back wall 22.

The lid flap 28 includes an upper lid flap panel 30 and a lower lid flap panel 32 connected along a first fold line 34. In addition, the lid flap 28 includes an opening tab 36 connected to the lower lid flap panel 32 about a second fold line 38. When the container 10 is assembled, as shown in FIG. 1, the opening tab 36 is folded upwards towards the lower lid flap panel 32 about the second fold line 38.

A first stopper tab 40 is additionally provided in the lower lid flap panel 32 and a second stopper tab 42 is provided in the rear wall panel 41 of the box of the inner slide. The first stopper tab 40 is pivotable towards the upper lid flap panel 30 about a fold line extending across the lower lid flap panel 32. The second stopper tab 42 is pivotable in a downwards direction towards the bottom of the inner slide 12 about a fold line extending across the rear wall panel 41 thereof.

The container 10 is assembled such that the first stopper tab 40 lies behind the second stopper tab 42. This interlocking arrangement of the stopper tabs 40, 42 limits the extent to which the inner slide 12 can be moved upwards relative to the outer shell 14 and therefore also the angle by which the lid 18 can be opened. The stopper tabs 40, 42 therefore prevent the inner slide 12 from being removed from the top opening of the outer shell 14.

A third stopper tab 44 is provided on the front wall panel of the box 16, the function of which will be described below. In the assembled container 10, the third stopper tab 44 is folded downwards by approximately 180 degrees.

The outer shell 14 includes a front wall 45, a rear wall 46, a left side wall 48 (shown in FIG. 2*b*) and a right side wall 49. The top end of the shell is open, to allow movement of the inner slide 12 out of the outer shell 14 into the open position. The bottom end of the shell is also open so that the inner slide can be pushed upwards by applying a force to its bottom wall.

Figure 2B:
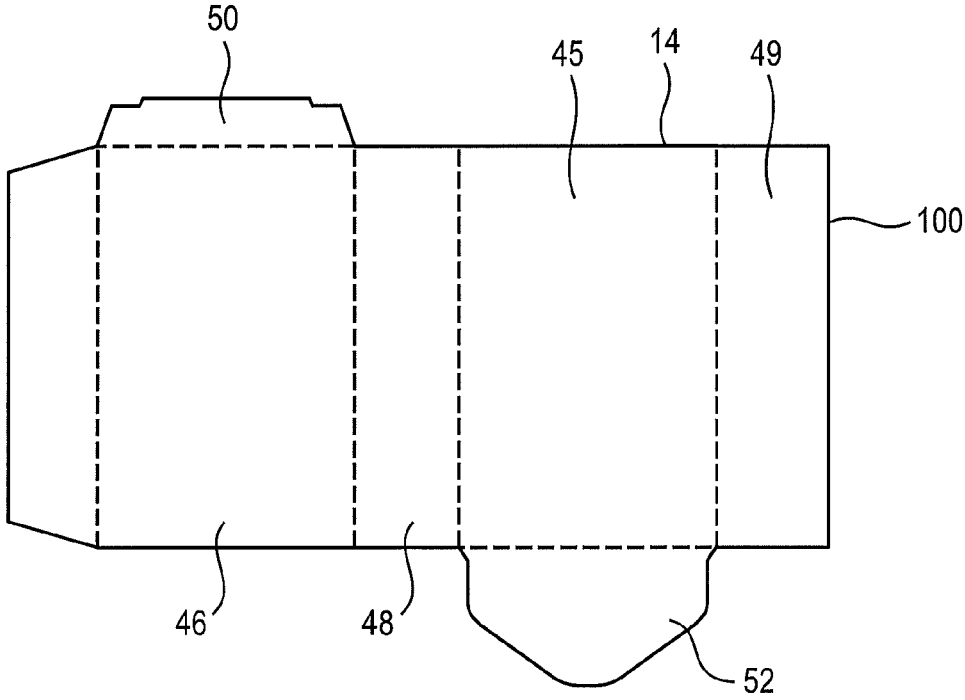

FIG. 2*b* shows the laminar blank 100 for forming the outer shell 14 of the container 10. As can be seen from FIG. 2*b*, the outer shell 14 includes an upper opening tab 50 extending from the top edge of the rear wall 46 and a lower stopper tab 52 extending from the lower edge of the front wall 45.

In the assembled container 10, the upper opening tab 50 is folded downwards inside the outer shell towards the rear wall 46 thereof about a fold line extending across the top edge of the rear wall 46. In use, the upper opening tab 50 of the outer shell 14 engages with the opening tab 36 of the lid flap 28 as the inner slide 12 is moved upwards relative to the outer shell 14. Once the upper opening tab 50 and opening flap 36 are engaged, any further upwards movement of the inner slide 12 relative to the outer shell 14 causes the lid 18 of the inner slide 12 to pivot open.

In the assembled container 10, the stopper tab 52 of the outer shell 14 lies behind the third stopper tab 44 in the inner slide 12. This interlocking arrangement of the stopper tabs 44, 52 limits the downwards movement of the inner slide 12 relative to the outer shell 14, so that the inner slide 12 cannot be removed from the bottom end of the outer shell 14.

In order to assemble the container 10, the inner slide 12 is formed around a wrapped bundle of consumer goods such as smoking articles and then the filled inner slide 12 is inserted into the outer shell 14, with the stopper tabs arranged as described above. The assembled container may then be overwrapped with a transparent wrapper, in the conventional manner.

Figure 2C:
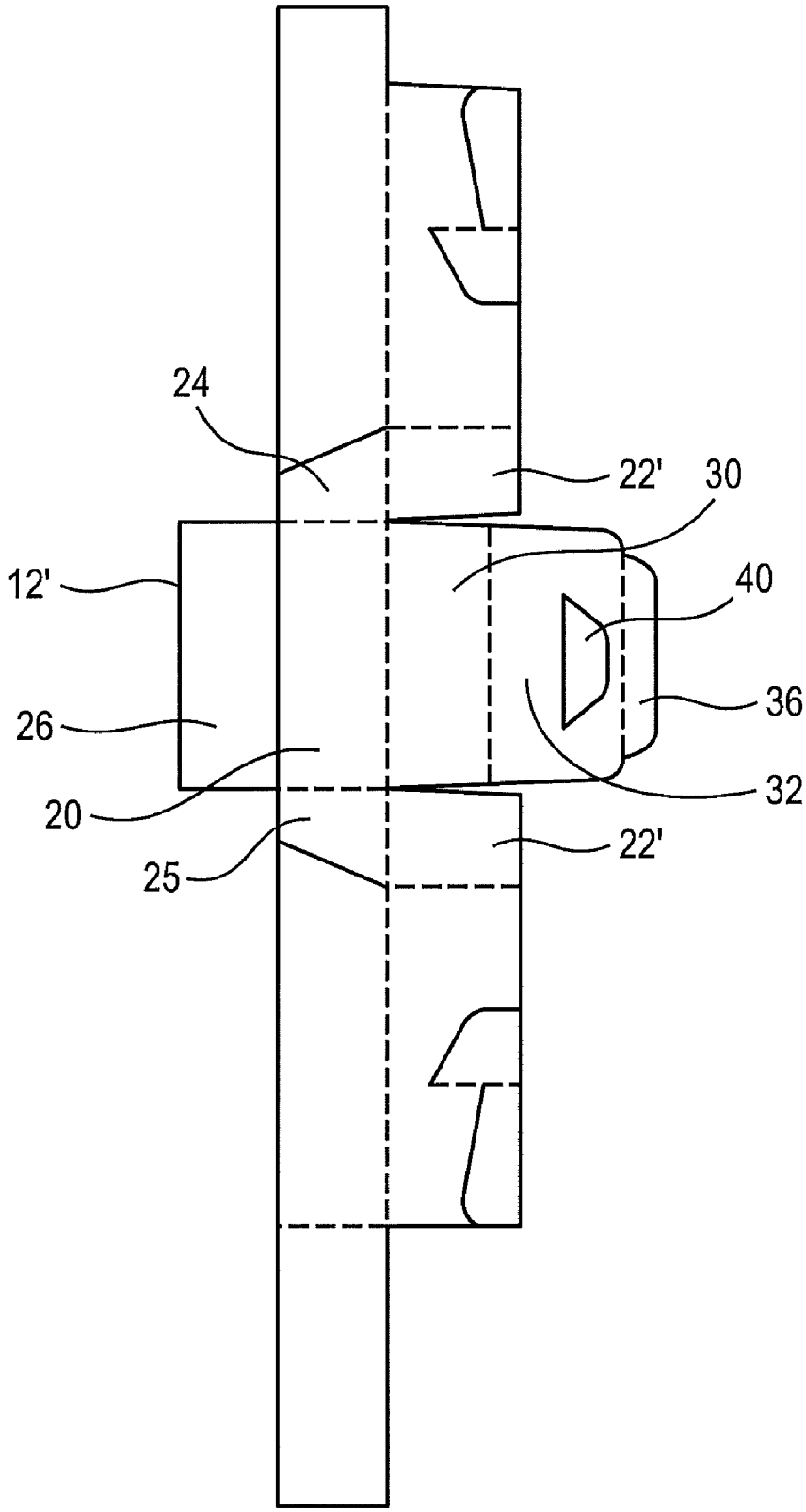
FIG. 2*c* is a plan view of an alternative laminar blank for forming the inner slide of the container of FIG. 1.

FIG. 2*c* shows an alternative laminar blank for forming an inner slide 12' for the container 10, which has a lid having a similar structure to that described above but has a box that does not include a front wall. The rear wall of the inner slide is formed from two panels of half of the total width of the inner slide, which are connected to the rear edges of the left and right side wall panels. The inner slide 12' formed from the blank shown in FIG. 2*c* may be mounted in the outer shell 14 formed from the blank shown in FIG. 2*b* and includes the same stopper tabs as the inner slide described above, so that it interacts with the outer shell in the same way.

Figure 3:
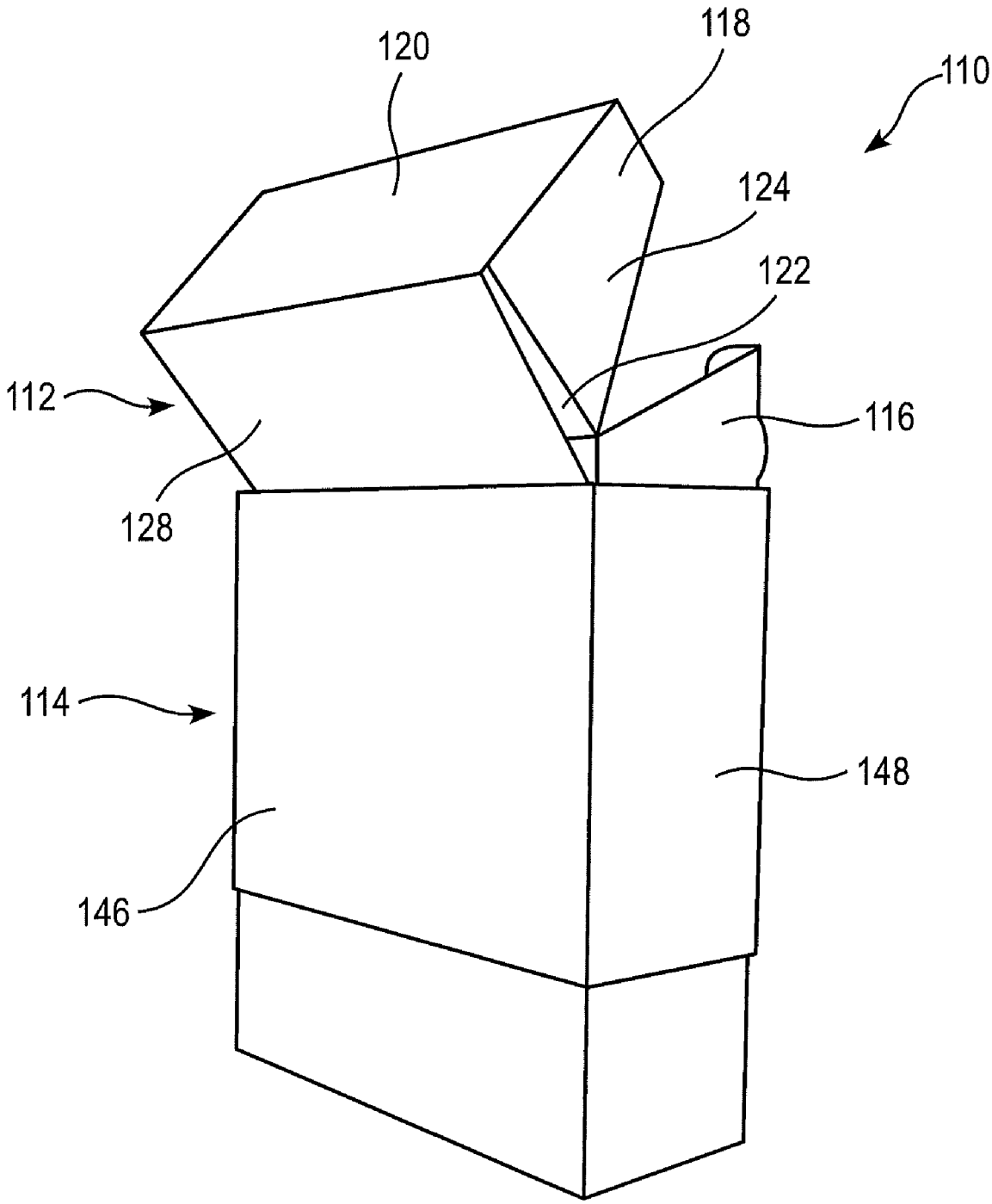
FIG. 3 is a perspective view of a container according to a second embodiment of the present invention, with the lid in an open position.

The container 110 of FIG. 3 includes an inner slide 112 mounted within an outer shell 114 for movement relative thereto between the open position shown in FIG. 3 and a closed position. The construction of the inner slide 112 and outer shell 114 are similar to the inner slide 12 and outer shell 14 of container 10 shown in FIG. 1, except that the length of the outer shell 114 is approximately two thirds that of the inner slide 112, so that in the closed position, the inner slide 112 is only partially covered by the outer shell 114 and projects from the bottom end thereof. The arrangement of the stopper tabs of container 110 also differs from those of container 10, as described below.

Figure 4A:
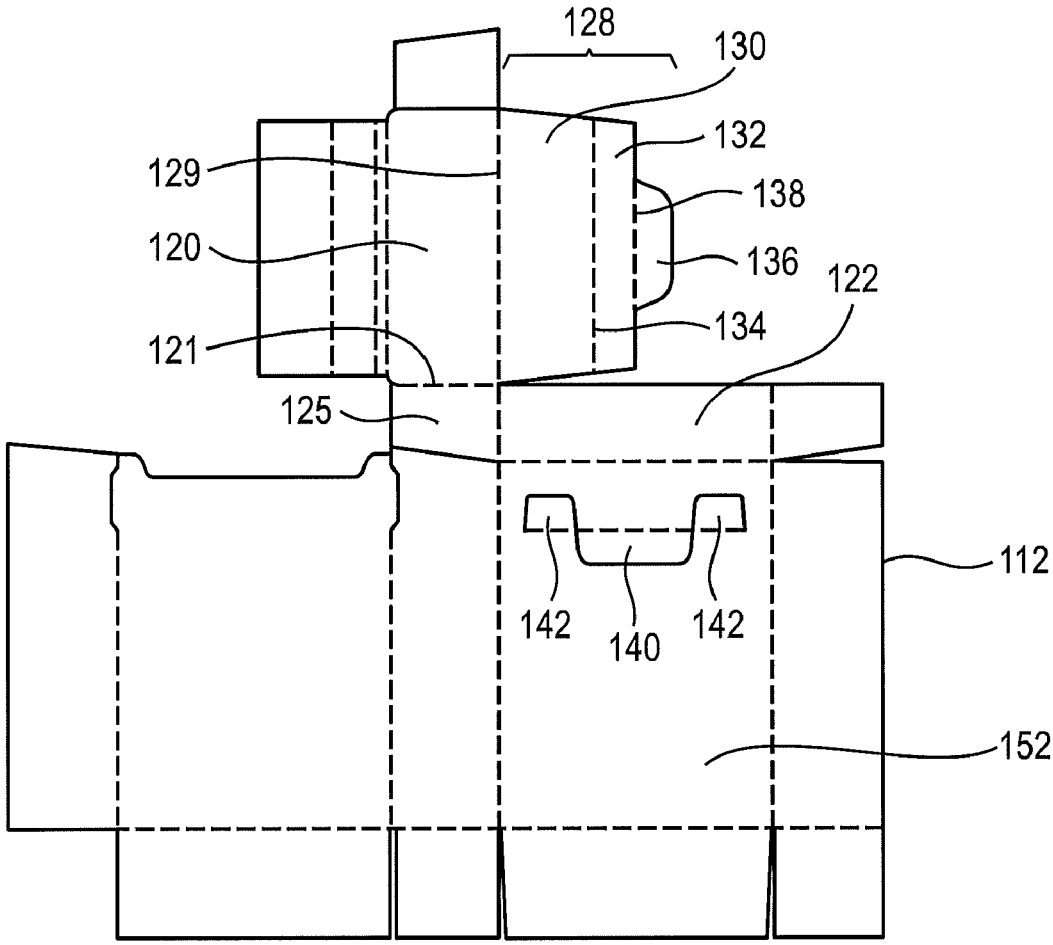
FIGS. 4*a* and 4*b* are plan views of the laminar blanks for forming the inner slide and outer shell, respectively, of the container of FIG. 3.

FIG. 4*a* shows the laminar blank for forming the inner slide 112 of the container 110. As can be seen from FIG. 4*a*, the lid top wall panel 120 is connected to the lid right side wall panel 125 along a transverse fold line 121 and the lid flap 128 is connected to the lid top wall panel 120 about a fold line 129, at right angles to the transverse fold line 121.

The lid flap 128 is of a similar construction to the lid flap 28 of container 10 except that the opening tab 136 does not extend across the full width of the lid flap 128 but only across the central portion thereof.

Unlike in the inner slide 12 of container 10, the lid flap 128 of inner slide 112 does not include a stopper tab. Instead, as shown in FIG. 4*a*, the rear wall 152 of the inner slide 112 includes a first stopper tab 140 and a pair of second stopper tabs 142 either side of the first stopper tab 140. The three stopper tabs 140, 142 are pivotable about a common hinge extending across the rear wall of the inner slide 112 and are formed from a common cut line.

In the assembled container 110, the first stopper tab 140 is folded in an upwards direction while the pair of second stopper tabs 142 are both folded in an opposite, downwards direction. The lower lid flap panel 132 is positioned behind the pair of second stopper tabs 142 with the second stopper tabs 142 positioned on either side of the opening tab 136. This arrangement ensures that the second stopper tabs 142 do not interfere with the functioning of the opening tab 136. The interlocking of the second stopper tabs 142 with the lower lid flap panel 132 limits the extent to which the lid of the inner slide 112 may be opened and also limits the upward movement of the inner slide 112 relative to the outer shell 114.

Figure 4B:
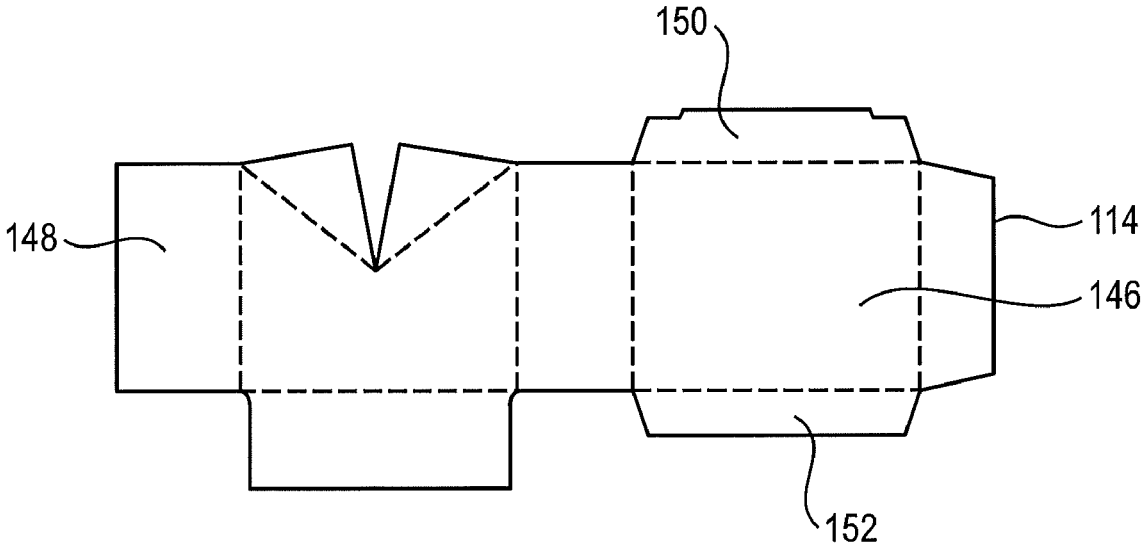

FIG. 4*b* shows the laminar blank for forming the outer shell 114 of the container 110. As can be seen from FIG. 4*b*, the outer shell 114 includes an upper opening tab 150 extending from the top edge of the rear wall 146 and a lower stopper tab 152 extending from the lower edge of the rear wall 146.

In the assembled container 110, the upper opening tab 150 is folded downwards towards the rear wall 146 of the outer shell 114 about a fold line coinciding with the top edge of the rear wall 146. In use, the upper opening tab 150 of the outer shell 114 engages with the opening tab 136 of the lid flap 128 as the inner slide 112 is moved upwards relative to the outer shell 114. Once the upper opening tab 150 and opening tab 136 are engaged, any further upwards movement of the inner slide 112 relative to the outer shell 114 causes the lid 118 of the inner slide 112 to pivot open.

In use, as the inner slide 112 is moved in an upwards direction relative to the outer shell, the stopper tab 152 of the outer shell 114 interlocks with the first stopper tab 140 on the rear wall of the inner slide 112 to limit the downwards movement of the inner slide 112 relative to the outer shell 114. This prevents the inner slide 112 being removed from the bottom end of the outer shell 114.

The container 110 may be assembled in the same manner as described above for container 10.

In this specification, the word "about" is often used in connection with numerical values to indicate that mathematical precision of such values is not intended. Accordingly, it is intended that where "about" is used with a numerical value, a tolerance of ±10% is contemplated for that numerical value.

In this specification the words "generally" and "substantially" are sometimes used with respect to terms. When used with geometric terms, the words "generally" and "substantially" are intended to encompass not only features which meet the strict definitions but also features which fairly approximate the strict definitions. In this connection, the term "rounded" is intended to also include configurations including two or more substantially straight line segments describing the "rounded" feature.

While the foregoing describes in detail a preferred a hinged lid container and methods of making the container with reference to a specific embodiment thereof, it will be apparent to one skilled in the art that various changes and modifications may be made to the container and equivalent methods may be employed, which do not materially depart from the spirit and scope of the foregoing description. Accordingly, all such changes, modifications, and equivalents that fall within the spirit and scope of the appended claims are intended to be encompassed thereby.

I claim:

1. A slide and shell container for consumer goods including an outer shell and an inner slide, wherein the inner slide comprises a box having a rear wall, a front wall and a lid hingedly connected to the box across a hinge, the lid including a lid flap extending from a top rear edge of the lid, a top wall, a back wall, a first sidewall and a second sidewall, the rear wall of the box including a second stopper flap, the front wall of the box including a third stopper flap, and the outer shell including a top opening flap extending from a top back edge of an outer shell rear wall and an outer shell stopper tab extending from an outer shell front wall, the top opening flap arranged between the outer shell and the inner slide such that as the inner slide is moved from a closed position in which the lid is closed to an open position in which the lid is open, the top opening flap of the outer shell engages with the lid flap of the inner slide, wherein the first stopper tab lies behind the second stopper tab in an interlocking arrangement such that upward movement of the inner slide relative to the outer shell is limited, the third stopper tab and the outer shell stopper tab provided in an interlocking arrangement such that downward movement of the inner slide relative to the outer shell such that the inner slide cannot be removed from a bottom end of the outer shell, wherein the lid flap is arranged between the inner slide and the outer shell such that an engagement of the lid flap and the outer shell is capable of opening the lid and the lid flap is wider than it is long, and wherein the first side wall is connected through a fold line to the back wall, and wherein the first side wall is connected through a fold line to the top wall.

2. The slide and shell container of claim 1, wherein the lid includes a lid inner top wall connected by a fold line to the lid top wall.

3. The slide and shell container of claim 1, wherein the inner slide is formed from a single laminar blank.

4. The slide and shell container of claim 1, wherein the lid back wall includes two separate panels.

5. The slide and shell container of claim 1, further including smoking articles.

6. A blank for making the inner slide of a slide and shell container of claim 1, wherein the blank comprises a box-defining portion and a lid-defining portion connected along a transverse hinge and wherein the lid-defining portion includes: a first lid side wall panel; a lid top wall panel connected to the first lid side wall panel along a first fold line; and a lid back wall panel connected to the first lid side wall panel along a second fold line substantially perpendicular to the first fold line.

7. The blank of claim 6, wherein the blank includes printing on one side thereof.

* * * * *